US007628477B2

(12) United States Patent
Umeda

(10) Patent No.: US 7,628,477 B2
(45) Date of Patent: Dec. 8, 2009

(54) DROPLET EJECTION APPARATUS AND INK-JET RECORDING APPARATUS

(75) Inventor: Takaichiro Umeda, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 548 days.

(21) Appl. No.: 11/509,164

(22) Filed: Aug. 24, 2006

(65) Prior Publication Data

US 2007/0046741 A1 Mar. 1, 2007

(30) Foreign Application Priority Data

Aug. 24, 2005 (JP) ..... 2005-242775

(51) Int. Cl.
*B41J 2/175* (2006.01)

(52) U.S. Cl. ..... 347/85

(58) Field of Classification Search ..... 347/84, 347/85, 86, 87
See application file for complete search history.

(56) References Cited

U.S. PATENT DOCUMENTS 3,950,761 A * 4/1976 Kashio ..... 347/85
5,485,187 A 1/1996 Okamura et al.
5,631,683 A 5/1997 Nishioka et al.
5,917,513 A 6/1999 Miyauchi et al.
6,494,568 B2 * 12/2002 Hou et al. ..... 347/86
6,663,233 B2 * 12/2003 Otsuka et al. ..... 347/85
7,290,861 B2 * 11/2007 Inoue et al. ..... 347/49
7,497,562 B2 * 3/2009 Childs et al. ..... 347/89

FOREIGN PATENT DOCUMENTS

| | | |
|---|---|---|
| JP | 5-82578 | 4/1993 |
| JP | 6-9952 | 2/1994 |
| JP | 7-232436 | 9/1995 |
| JP | 7290722 | 11/1995 |
| JP | 8-25653 | 1/1996 |
| JP | 10129007 | 5/1998 |
| JP | 200331197 | 11/2003 |

* cited by examiner

*Primary Examiner*—Anh T. N. Vo
(74) *Attorney, Agent, or Firm*—Reed Smith LLP

(57) ABSTRACT

A droplet ejection apparatus is provided of which maintenancibility is improved while liquid stored therein is prevented from being wasted at the time of maintenance. The apparatus includes a main tank storing the liquid, a head unit including a sub-tank that temporarily stores the liquid fed from the main tank and an ejection head that ejects the liquid fed from the sub-tank as droplets, a head unit transfer device that transfers the head unit to a predetermined position, a displacement member disposed to freely move in the liquid in a liquid supply passage from the sub-tank to the ejection head, a continuous pressurizing unit that continuously moves the displacement member to continuously apply pressure to the liquid, and an instantaneous pressurizing unit that instantaneously moves the displacement member to instantaneously apply pressure to the liquid.

13 Claims, 15 Drawing Sheets

DROPLET EJECTION APPARATUS AND INK-JET RECORDING APPARATUS

CROSS-REFERENCE TO RELATED APPLICATIONS

This application claims the benefit of Japanese Patent Application No. 2005-242775 filed Aug. 24, 2005 in the Japan Patent Office, the disclosure of which is incorporated herein by reference.

BACKGROUND

This invention relates to a droplet ejection apparatus that ejects liquid supplied from a sub-tank as droplets. This invention is particularly effective when applied to an ink-jet recording apparatus (ink-jet printer).

When there is a bubble or a foreign body choked inside an ejection head of a droplet ejection apparatus, or a solid body or a slurry stuck to the ejection head, the droplet ejection apparatus is no longer able to eject droplets normally. The solid body or slurry here is a transformed body of an ingredient contained in liquid, which viscosity is increased by evaporation of moisture. Accordingly, an ink-jet recording apparatus including a droplet ejection apparatus, for example, is no longer able to obtain a favorable image (recording result).

To solve this problem, for example, an ink-jet recording apparatus includes a recovery function of a positive pressure purge system. In the ink-jet recording apparatus, the air inside the sub-tank is compressed using an air pump to apply pressure (positive pressure) to the ink inside the sub-tank. The pressure washes away the ink to the downstream so as to discharge the ink from the ejection head. In this manner, ink and foreign bodies inside the ejection head are removed.

SUMMARY

In a positive pressure purge system as above, it is difficult to achieve sufficient recovery effects if a discharge speed of ink is less than a predetermined speed (e.g., 0.1 m/s).

The larger the discharge speed is, the larger the difference (hereinafter, referred to as "pressure difference") between the pressure inside the sub-tank and the atmospheric pressure. Therefore, it is necessary to set the pressure difference to a predetermined value and above in order to set the discharge speed of ink to the predetermined speed or above.

In the above ink-jet recording apparatus, the pressure difference is increased by compression of the air, that is, compressible fluid. inside the sub-tank. Therefore, compared to the case in which incompressible fluid like liquid is compressed, the pressure rising speed (pressure propagation speed) is slow, requiring time until the ink discharge speed reaches the predetermined speed.

On the other hand, the pressure difference required to simply discharge (eject) ink is much lower than the pressure difference (hereinafter, referred to as "necessary pressure difference") required for the ink discharge speed to reach the predetermined speed. Therefore, in the above ink-jet recording apparatus, a great amount of ink is discharged during a period from when the ink starts to be discharged (ejected) from the ejection head until the ink discharge speed reaches the predetermined speed and above.

Accordingly, the above ink-jet recording apparatus has a problem that much ink is wasted at the time of operation of the recovery function (positive pressure purge).

In a droplet ejection apparatus which temporarily stores liquid fed from a main tank in a sub-tank and then supplies to the ejection head, a bubble and a foreign body may be choked or an ingredient in the liquid in a solid or slurry form may be stuck in a liquid supply passage from the main tank to the sub-tank.

Similar to the above ink-jet recording apparatus, there may be provided a recovery device that increases the difference between the pressure inside the main tank and the air pressure so that the foreign body and slurry ingredient choked in the liquid supply passage from the main tank to the sub-tank can be discharged with ink from the ejection head. However, as noted above, it is most likely that much ink is wasted due to a slow pressure increase.

Also, the length of the liquid supply passage from the main tank to the sub-tank and further to the ejection head is relatively long. Therefore, relatively much time is required to discharge the liquid in the liquid supply passage using a normal air pump. Thus, when there are a lot of bubbles in the liquid supply passage such as at the time of initial startup or liquid refill, a great deal of time is required for the operation of discharging bubbles (maintenance). There is a problem that the maintenancibility is low.

The problem of maintenancibility may be solved by using a large-sized air pump. However, this leads to an increase in size and manufacturing cost of the droplet ejection. apparatus. The problem of wasting much ink still remains.

The present invention is made to solve the above problems. It would be desirable to improve maintenancibility of a droplet ejection apparatus that temporarily stores liquid like ink fed from a main tank in a sub-tank to be fed to the ejection head, preventing the liquid from being wasted during the maintenance such as at the time of recovery function operation and initial startup.

One aspect of the present invention may provide a droplet ejection apparatus that includes a main tank that stores liquid; a head unit that includes a sub-tank that temporarily stores the liquid fed from the main tank and an ejection head that ejects the liquid fed from the sub-tank as droplets; a head unit transfer device that transfers the head unit to a predetermined position; a displacement member that is disposed to freely move in the liquid in a liquid supply passage from the sub-tank to the ejection head; a continuous pressurizing unit that continuously moves the displacement member to continuously apply pressure to the liquid; and an instantaneous pressurizing unit that instantaneously moves the displacement member to instantaneously apply pressure to the liquid.

When removing bubbles and foreign bodies choked in the ejection head, it is sufficient to discharge only the liquid present inside the ejection head. It is only necessary to instantaneously (sporadically) apply pressure to the liquid inside the ejection head.

On the other hand, the liquid existing in the liquid supply passage from the main tank to the sub-tank is much more than the liquid present in the ejection head. Therefore, in order to discharge bubbles and foreign bodies choked in the liquid supply passage from the main tank to the sub-tank, it is necessary to transmit a great deal of liquid to the ejection head side in a short time by continuously applying pressure to the liquid.

The droplet ejection apparatus of the present invention permits generation of an instantaneous pressurized stream that provides instantaneous (sporadic) application of pressure to the liquid inside the ejection head and a continuous pressurized stream that provides continuous application of pressure to the liquid. Therefore, in either case in removing bubbles or foreign bodies choked inside the ejection head or in the liquid supply passage from the main tank to the sub-tank, the liquid to be consumed can be saved. Furthermore, bubbles and foreign bodies choked in the liquid supply passage can be quickly removed.

Another aspect of the present invention may provide a droplet ejection apparatus that includes a main tank that stores liquid; a head unit that includes a sub-tank that temporarily stores the liquid fed from the main tank and an ejection head that ejects the liquid fed from the sub-tank as droplets; a head unit transfer device that transfers the head unit to a predetermined position; a screw pump device; a screw rotation device; and a screw displacement device. The screw pump device is provided with a screw having a rotation shaft displaceably supported in an axial direction and a spiral wing formed at an outer periphery of the rotation shaft. The screw pump device further includes a housing forming a cylindrical storage space for accommodation of the screw and having a discharge opening at an end in a longitudinal direction. The screw pump device delivers the liquid toward the ejection head side. The screw rotation device rotates the screw. The screw displacement device axially displaces the screw to the discharge opening side.

According to the above droplet ejection apparatus, the screw pump device transmits the liquid as incompressible fluid toward the ejection head side, while directly applying pressure to the liquid and not to compressible fluid like the air. Therefore, a difference between the pressure inside the sub-tank and the air pressure can be instantaneously increased to a required pressure difference, thus preventing the liquid from being wasted at the time of the recovery function operation.

In the above droplet ejection apparatus, the screw can be rotated and displaced in an axial direction. Thus, rotation of the screw by the screw rotation device can continuously apply pressure to the liquid and transmit a lot of liquid to the ejection head side, while displacement of the screw to the discharge opening side by the screw displacement device can provide instantaneous (sporadic) application of pressure to the liquid inside the ejection head.

Accordingly, waste of the liquid at the time of maintenance like recovery function operation and initial startup can be reduced in the present droplet ejection apparatus. Maintenancibility can be also improved.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

1. Description of Multi Function Apparatus 1

The present invention is applied to an ink-jet recording apparatus as a so-called multi function apparatus including a printer function, a scanner function, a copying function, and a facsimile function.

Figure 1:
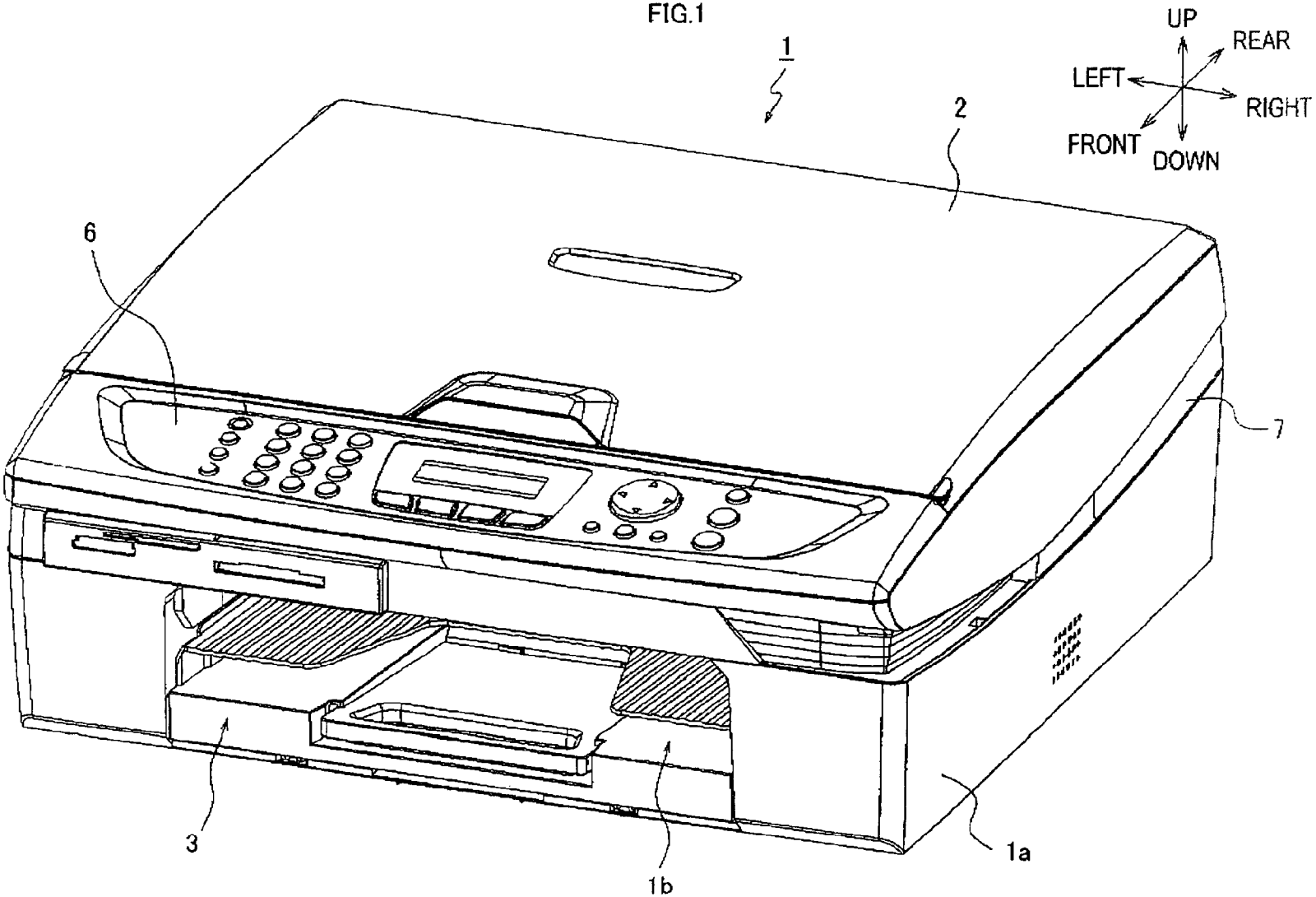
FIG. 1 is an external view of a multi function apparatus according to an embodiment of the present invention.
Figure 2:
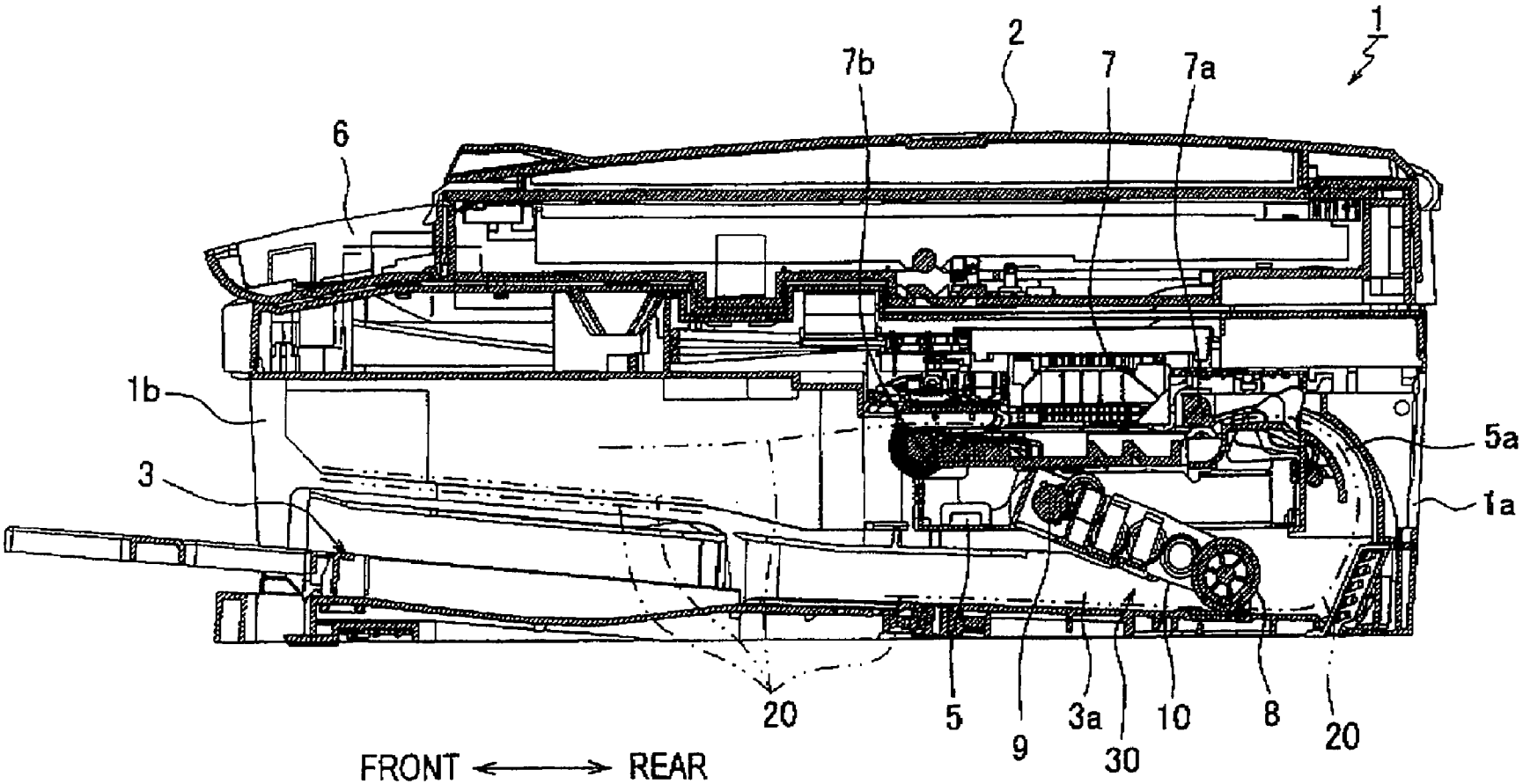
FIG. 2 is a cross sectional view of the multi function apparatus according to the embodiment of the present invention.

Referring to FIG. 1, a multi function apparatus 1 is provided with a scanner 2 on the upper part for reading an image, and a casing 1*a* on the lower part. As shown in FIG. 2, an ink-jet recording apparatus 7 is provided in the upper part inside the casing 1*a*. The ink-jet recording apparatus 7 records (forms) an image onto a recording sheet 20 as a recording medium. In the lower part inside the casing 1*a*, a sheet feeding device 30 is provided which supplies the recording sheet 20 to the ink-jet recording apparatus 7.

A frame 5 is provided on the rear side inside the casing 1*a* and on the upper side of the sheet feeding device 30. The frame 5 is formed nearly into a rectangular parallelepiped which extends in a right and left direction (direction perpendicular to the surface of FIG. 2 drawing). The ink-jet recording apparatus 7 is disposed on the frame 5. In the rear of the frame 5, a conveying path 5*a* is formed which guides the recording sheet 20 placed on the sheet feeding device 30 to the ink-jet recording apparatus 7.

The ink-jet recording apparatus 7 includes a conveying roller 7*a* provided adjacent to an exit of the conveying path 5*a*, and a discharge roller 7*b* provided where the recording sheet 20 with an image recorded thereon is discharged. The conveying roller 7*a* rotates by receiving a rotational driving force of a sheet conveying motor 123 (see FIG. 5). Detailed structure of the ink-jet recording apparatus 7 will be explained later.

The sheet feeding device 30 has a feed cassette 3 attached through an opening 1*b* of the casing 1*a*. The feed cassette 3 includes a sheet storage 3*a* that stores plural number of recording sheets 20.

The topmost recording sheet 20 out of the recording sheets 20 stored in the sheet storage 3*a* is transmitted to the ink-jet recording apparatus 7 via the conveying path 5*a*, given a conveying force from the feeding roller 8.

The feeding roller 8 is rotatably supported to a tip end of an arm 10 which is rotatably (pivotably) held by a driving shaft 9. A rotational force that rotates the feeding roller 8 is supplied from a sheet feeding motor 122 (see FIG. 5) via the driving shaft 9.

As shown in FIG. 1, an operation panel 6 having various operation buttons and a liquid crystal panel is provided at the front on the upper part of the multi function apparatus 1. A user can set up various setting items of the multi functional apparatus 1, input necessary information such as a facsimile number, and confirm the operation state and communication records by operation of the various operation buttons on the operation panel 6.

2. Structure of Ink-jet Recording Apparatus 7

2.1 Overall Structure of Ink-jet Recording Apparatus 7

Figure 3:
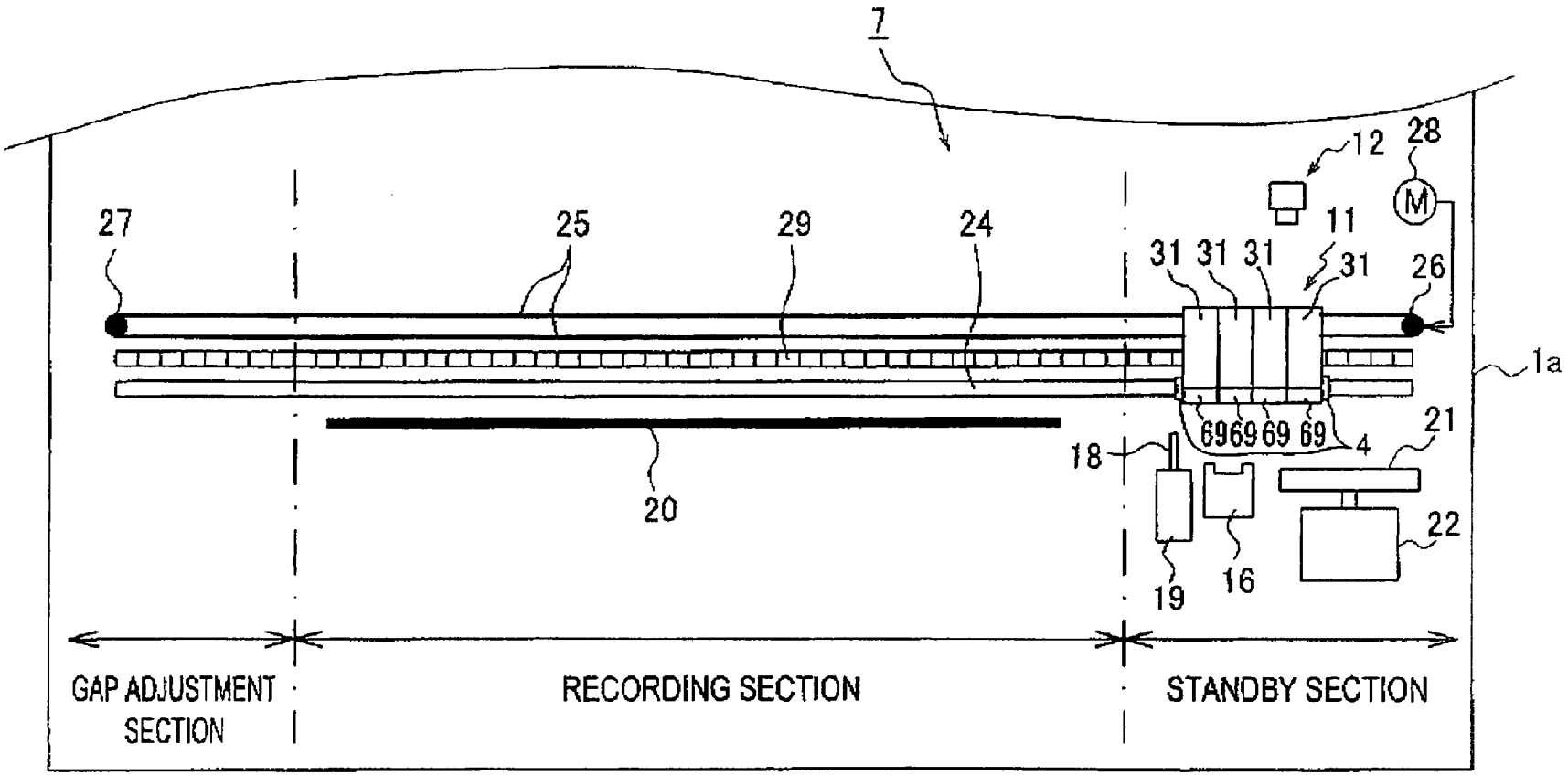
FIG. 3 is a schematic diagram showing an ink-jet recording apparatus according to the embodiment of the present invention.

The ink-jet recording apparatus 7 is a sort of image forming apparatus which forms an image on the recording sheet 20 by ejecting ink onto the recording sheet 20 using a droplet ejection apparatus according to the present invention. FIG. 3 is a schematic diagram of the ink-jet recording apparatus 7.

A head unit 11 is mounted on a carriage 4. The head unit 11 moves parallel to (back and forth in) a direction orthogonal to a conveying direction of the recording sheet 20 (right and left direction on the surface of FIG. 3 drawing). The head unit 11 includes a plurality of recording heads 69 and a plurality of sub-tanks 31. Detail of the head unit 11 will be explained later.

A guide bar 24 extends along a moving direction of the carriage 4 (head unit 11) to guide the transfer of the carriage 4. The carriage 4 is connected to an endless belt 25 provided along the guide bar 24.

The endless belt 25 extends between a pulley 26 provided on one end side of the guide bar 24 (right side in FIG. 3) and an idle pulley 27 provided on the other end side. The pulley 26 is rotationally driven by a carriage motor 28. Accordingly, as the carriage motor 28 is driven to rotate the endless belt 26, the carriage 4, that is, the head unit 11, mechanically moves parallel in a right and left direction in FIG. 3.

In the vicinity of the guide bar 24, a timing slit 29 is arranged which extends parallel to the guide bar 24. The timing slit 29 has linear slits of a certain width formed per predetermined interval in a longitudinal direction.

The carriage 4 has a detector (not shown) constituted of a photo interrupter in which a light-emitting element and a light-receiving element face each other with the timing slit 29 therebetween. The detector and the timing slit 29 constitute a linear encoder (carriage feed encoder) 118 (see FIG. 5) that detects a moving distance (position) of the carriage 4 (head unit 11).

As shown in FIG. 3, the area where the carriage 4 moves back and forth along (parallel to) the guide bar 24 is divided into three sections, i.e., a recording section where recording is performed onto the recording sheet 20, a standby section and a gap adjustment section where no recording is performed.

The standby section is provided in the vicinity of an end of the guide bar 24 on the pulley 26 side. In the standby section, the carriage 4 stands by for a period during which neither recording nor maintenance is performed, or later-explained wiping or recovery operation (positive purge) is performed.

The gap adjustment section is for operation of a not shown gap adjustment device. The gap adjustment device adjusts a gap between each nozzle 37 (see FIG. 4) of the recording head 69 and the recording sheet 20 to an appropriate value.

A cap 21 is a cover member that covers the nozzles 37 of the recording head 69 to prevent the ink retained in the nozzles 37 from being dried. The cap 21 operates, driven by a cap driving portion 22.

The cap 21 and the cap driving portion 22 are arranged at the lower side of the recording head 69 in the standby section. When the carriage 4 is stopped at a predetermined position in the standby section, the cap driving portion 22 ascends the cap 21 so that the cap 21 abuts on the under surface of the recording head 69 to cover the nozzles 37. To the contrary, when moving the carriage 4 such as at the time of recording operation or maintenance, the cap driving portion 22 descends the cap 21 to disclose the nozzles 37.

Adjacent to the cap 21 in a moving direction of the carriage 4, there are provided a waste ink tray 16 that receives ink discharged (ejected) from the nozzles 37 at the time of recovery operation, and a wiper blade 18 that wipes ink attached on an opening plane of the nozzles 37.

A wiper driving portion 19 moves the wiper blade 18. The wiper blade 18 stands by normally at a distance from the recording head 69 (nozzles 37). However, at the time of recovery operation, the wiper blade 18 moves as close to the recording head 69 (nozzles 37) as that the edge portion thereof may contact with the nozzles 37.

At the upper side of the head unit 11 in the standby section, a screw driving portion 12 is provided which axially rotates or displaces a later-explained screw 33.

The screw driving portion 12 is disposed inside the casing 1*a* via a not shown frame. The screw driving portion 12 is provided so as to be able to move up and down. Detail of the screw driving portion 12 will be explained later.

2.2 Structure of Head Unit 11 and Screw Driving Portion 12

Figures 4A, 4B:
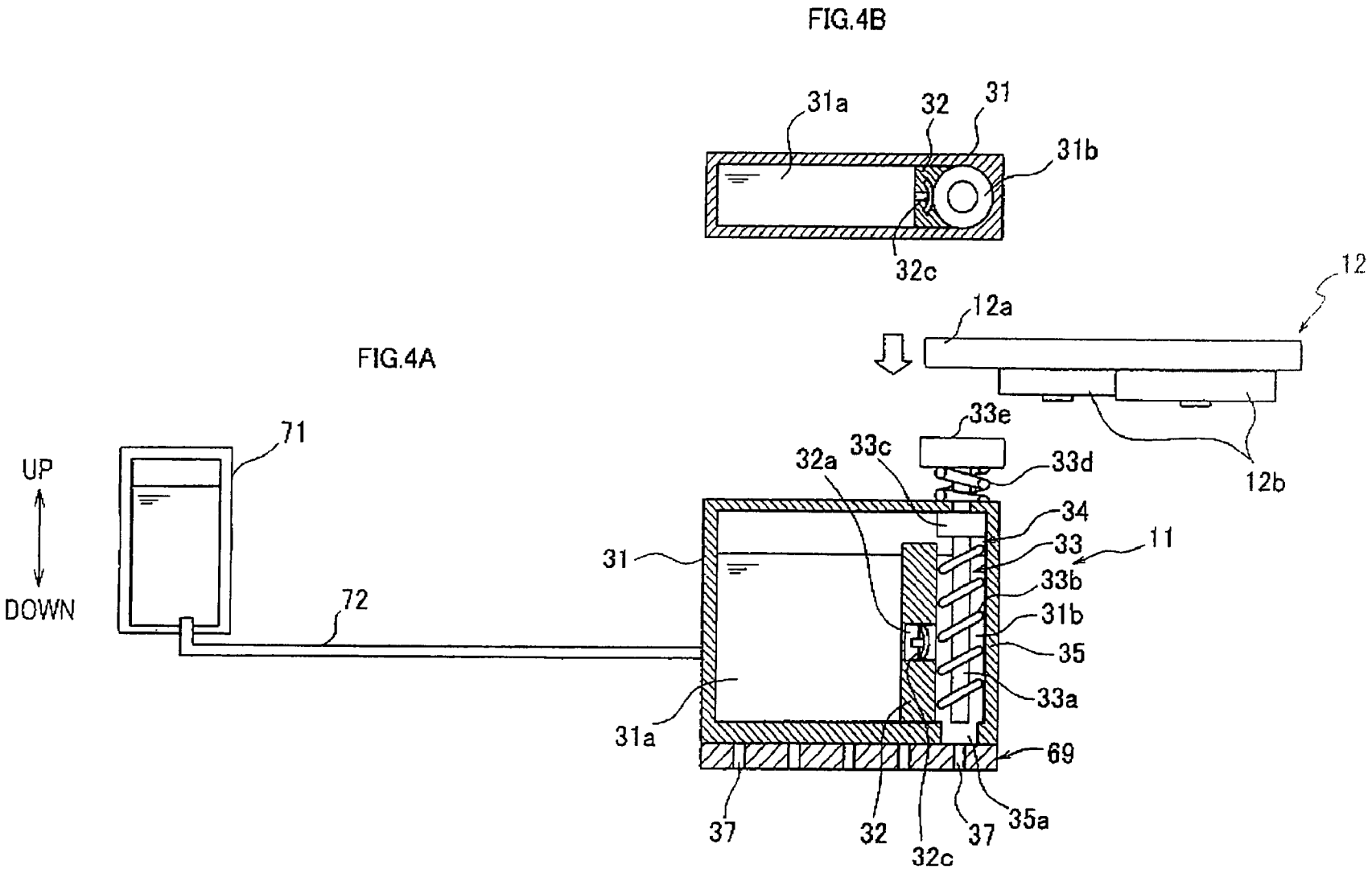
FIGS. 4A and 4B are diagrams showing a structure of a cartridge and a sub-tank according to the embodiment of the present invention.

FIG. 4A is a schematic diagram showing an ink supply passage including the head unit 11, and FIG. 4B is a top view of the sub-tank 31. As shown in FIG. 4A, the recording head 69 having the plurality of nozzles 37 that eject ink as droplets (ink drops) is provided at the lower side of the head unit 11. The recording head 69 in the present embodiment is a known type which uses a piezoelectric device.

At the upper side of the recording head 69, a sub-tank 31 is provided which temporarily stores ink supplied from an ink cartridge (main tank) 71 via a tube 72. There are a number of sub-tanks 31 and cartridges 71 which correspond to the number of ink colors. In the present embodiment, there are four sub-tanks 31 and cartridges 71, respectively, which correspond to four colors of black, cyan, yellow and magenta.

The sub-tanks 31 and the cartridges 71 are different from each other in only stored ink colors. Therefore, only a description for the sub-tank 31 storing black ink (leftmost side in FIG. 3) is provided hereinafter.

The sub-tank 31 is formed into a flat cube (see FIG. 4B) which is divided into two spaces 31*a* and 31*b* by a partition wall 32. One of the space 31*a* (hereinafter, referred to as "sub-tank portion 31*a*") out of the two spaces 31*a* and 31*b* directly communicates with the tube 72.

On the other hand, the space 31*b* (hereinafter, referred to as "storage space 31*b*") is formed nearly into a cylinder which extends in a vertical direction. The storage space 31*b* communicates with the tube 72 via a communication path 32*a* provided in the partition wall 32. A check valve 32*c* that prevents adverse current of ink from the storage space 31*b* to the sub-tank portion 31*a* is provided in the communication path 32*a* which communicates the sub-tank portion 31*a* and the storage space 31*b*.

The storage space 31*b* stores a screw 33 including a rotation shaft 33*a* and a spiral wing 33*b* formed on the outer circumference of the rotation shaft 33*a*. The screw 33 and a member composing the storage space 31*b* like the partition wall 32 (hereinafter, the member referred to as "housing 35") constitute a screw pump 34 that delivers ink to the recording head 69 (nozzles 37).

The rotation shaft 33*a* of the screw 33 can be displaced in an axial direction (up and down direction in the present embodiment). The rotation shaft 33*a* is rotatably supported to the housing 35. The rotation shaft 33*a* rotates or is axially displaced by a rotational force or an axial displacement force received from the screw driving portion 12.

At the lower end in a longitudinal direction of the housing 36 (storage space 31*b*), a discharge opening 35*a* is provided which communicates with the recording head 69, i.e., the plurality of nozzles 37. At the upper end in a vertical direction, a lid member 33*c* is provided which closes an end on the upper side in a longitudinal direction of the housing 35 (storage space 31*b*) when the screw 33 is axially displaced to the lower end side.

In FIG. 4A, the discharge opening 35*a* appears as if it communicates with only the rightmost nozzle 37. However, the discharge opening 35*a* communicates with all the nozzles 37 via a not shown dispensing path.

In the present embodiment, the lid member 33*c* is integrally formed with the screw 33 (rotation shaft 33*a*). Therefore, the lid member 33*c* opens/closes the upper end in a longitudinal direction of the housing 35 (storage space 31*b*) in mechanical conjunction with the axial displacement of the screw 33.

A spring 33*d* biases the screw 33 to the upper end side in the longitudinal direction of the housing 35 (storage space 31*b*). In the present embodiment, the spring 33*d* is constituted from a coil-like metal spring or rubber.

A gear 33*c* is connected to the upper end side in the longitudinal direction of the screw 33 (rotation shaft 33*a*). The gear 33*e* transmits a rotational force given from the screw driving portion 12 to the screw 33. In the present embodiment, the spring 33*d* is arranged between the gear 33*e* and the housing 35. Accordingly, a resilient force of the spring 33*d* is transmitted to the screw 33 via the gear 33*e*.

The screw driving portion 12 includes a slide pressing portion 12*a* that moves in a direction parallel to a longitudinal direction of the screw 33 (rotation shaft 33*a*) and presses the upper end side in the longitudinal direction of the screw 33 toward the lower end side (discharge opening 36*a* side), a connecting gear 12*b* that moves up and down integrally with the slide pressing portion 12*a* to transmit a rotational force to the gear 33*e*, and a screw driving portion 12*c* (see FIG. 5) that supplies power to the slide pressing portion 12*a* or the connecting gear 12*b*.

3. Electric Structure of Ink-jet Recording Apparatus 7

Figure 5:
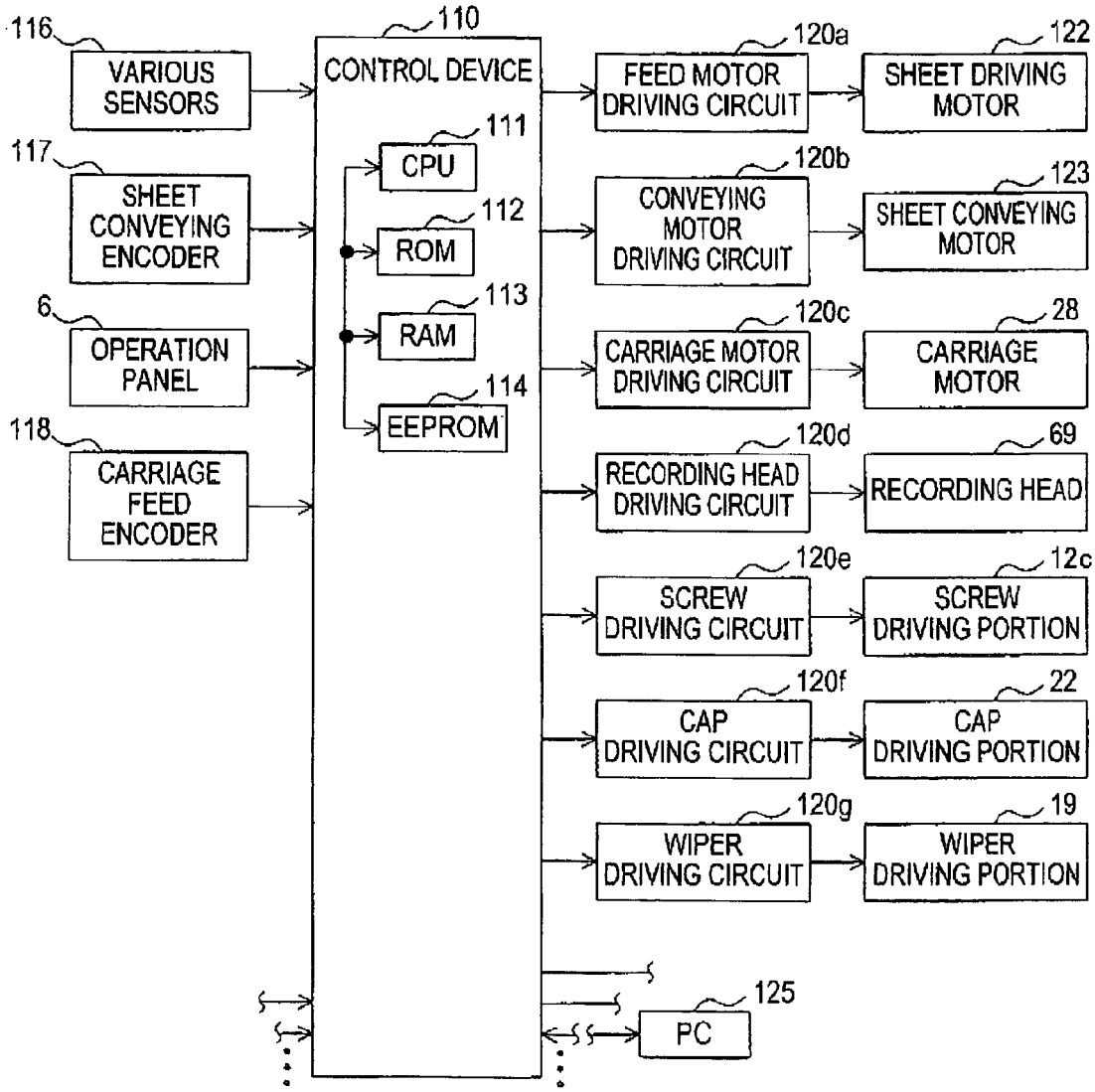
FIG. 5 is a diagram showing an electric constitution of the ink-jet recording apparatus according to the embodiment of the present invention.

FIG. 5 is a block diagram showing an electric constitution of the ink-jet recording apparatus 7. As shown in FIG. 5, the ink-jet recording apparatus 7 includes a control device 110 that controls later-explained respective driving circuits 120*a* to 120*g*. The control device 110 is constituted from a CPU 111, a ROM 112, a RAM 113 and an EEPROM 114.

The control device 110 receives outputs from various sensors 116 such as a known media sensor or resist sensor that can detect presence of the recording sheet 20, a front end, a rear end and ends in a width direction of the recording sheet 20, a sheet conveying encoder 117 that detects a conveying distance (position) of the recording sheet 20, the operation panel 6, and a carriage feeding encoder 118.

Outputs from the control device 110 are inputted to a feed motor driving circuit 120*a* that drives the feed motor 122, a conveying motor driving circuit 120*b* that drives the feed conveying motor 123, a carriage motor driving circuit 120*c* that drives the carriage motor 28, a recording head driving circuit 120*d* that drives the recording head 69 (piezoelectric element), a screw driving circuit 120*e* that drives the screw driving portion 12*c*, a cap driving circuit 120*f* that drives the cap driving portion 22, and a wiper driving circuit 120*g* that drives the wiper driving portion 19.

The control device 110 controls each driving target through the CPU 111 which controls the respective driving circuits 120*a* to 120*g* according to various programs stored in the ROM 112 and the EEPROM 114.

The multi function apparatus 1 of the present embodiment can communicate with a personal computer (hereinafter, referred to as "PC") 125. According to recording instructions from the PC 125, the multi function apparatus 1 records image data transmitted together with the instructions onto the recording sheet 20.

4. Characteristic Operation of Ink-jet Recording Apparatus 7 of Present Embodiment The ink-jet recording apparatus 7 of the present embodiment can generate two types of pressurized streams at the time of maintenance such as at recovery function operation and initial startup. One is an instantaneous pressurized stream which instantaneously (sporadically) pressurizes ink inside the recording head 69, and the other is a continuous pressurized stream which continuously pressurizes ink inside the recording head 69.

4.1.1. Instantaneous Pressurized Stream

Figure 6A:
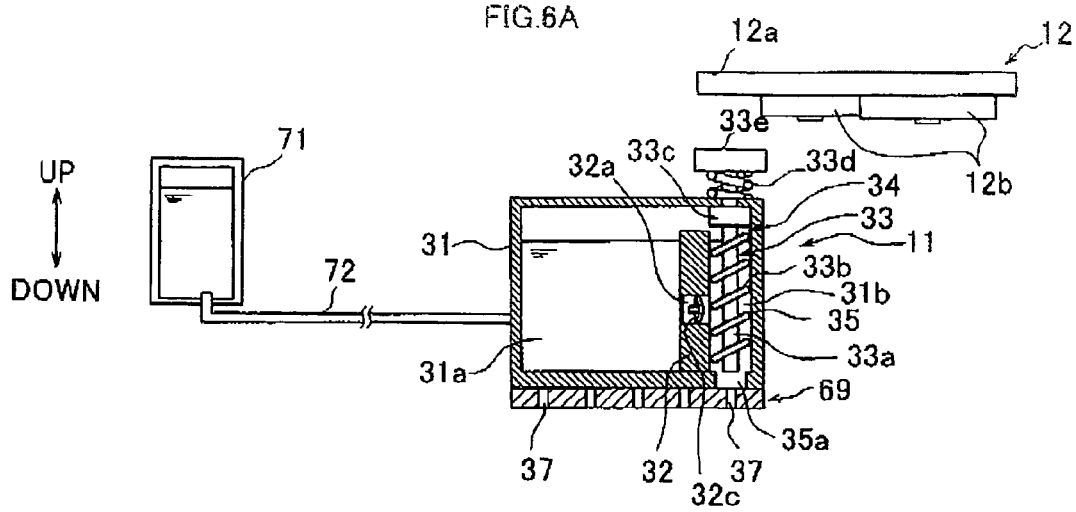
FIGS. 6A, 6B and 6C are diagrams showing operation of an instantaneous pressurizing process.
Figure 6B:
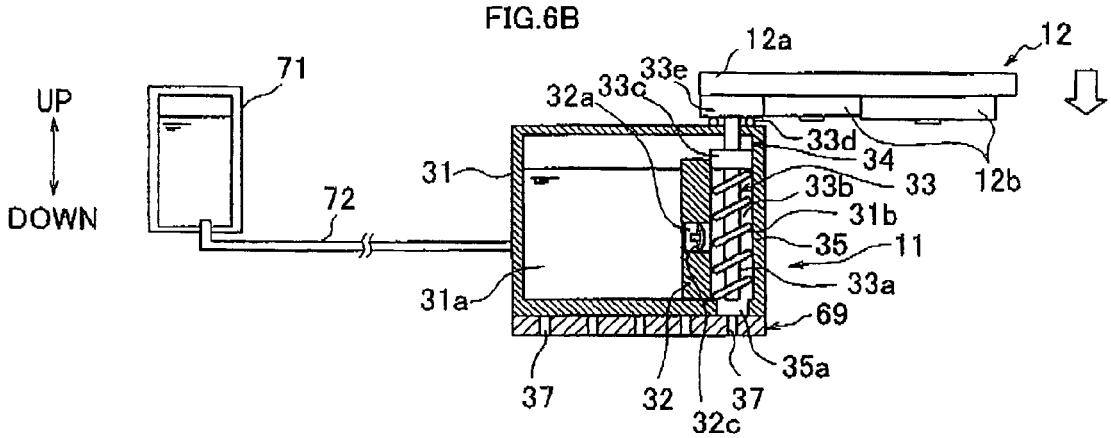
Figure 6C:
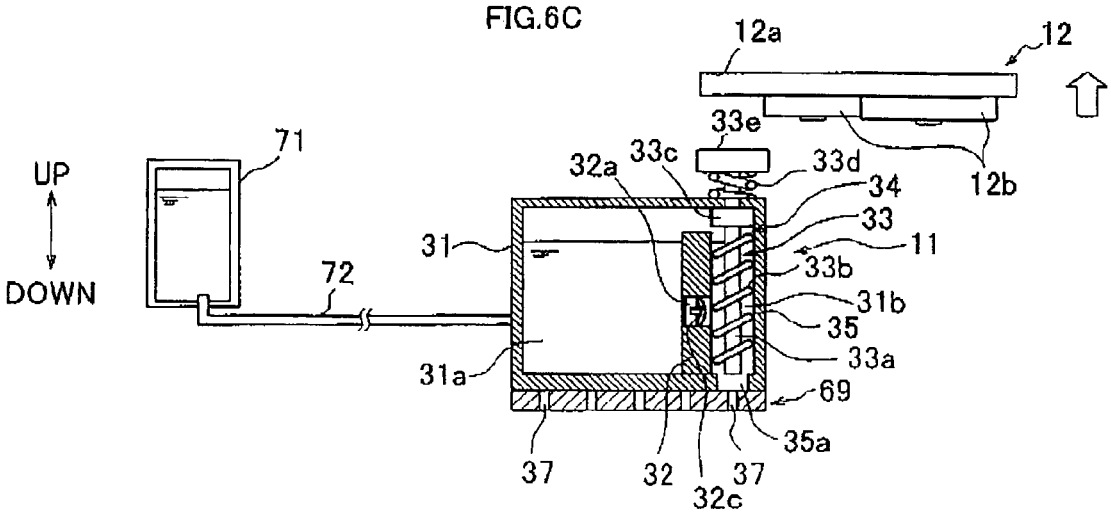

FIGS. 6A to 6C show operation of the screw driving portion 12 in the case of generating an instantaneous pressurized stream. Firstly as shown in FIG. 6A, the carriage 4 is moved so that the sub-tank 31 in which generation of an instantaneous pressurized stream is desired, that is, the sub-tank 31 corresponding to the recording head 69 (nozzles 37) on which recovery operation is to be performed, is positioned directly below the screw driving portion 12.

Next, as shown in FIG. 6B, the screw driving portion 12 is descended to press the upper end side (gear 33*e*) of the screw 33 with the slide pressing portion 12*a*. Thereby, the ink inside the storage space 31 (housing 35) is pressurized by the screw 33 (particularly by the wing 33*b*) to the discharge opening 35*a* side. As a result, an instantaneous (sporadic) pressurized stream is generated and the ink is discharged from the recording head 69 (nozzles 37).

It is necessary that the descending speed of the slide pressing portion 12*a* is set to generate the discharge speed which is sufficient to remove the ink with increased viscosity or foreign bodies out of the recording head 69. The particular descending speed should be determined considering a hole diameter and the number of the nozzles 37 and a gap between the screw 33 (wing 33*b*) and the internal wall of the housing When the screw driving portion 12 is ascended, the screw 33 returns to the upper side (original position) by a resilient force of the spring 33*d*. Thus, if the screw driving portion 12 is again descended, an instantaneous pressurized stream is regenerated.

When terminating the recovery operation, the screw driving portion 12 is ascended until the slide pressing portion 12*a* is no longer in contact with the screw 33, as shown in FIG. 6C.

4.1.2. Continuous Pressurized Stream

Figure 7A:
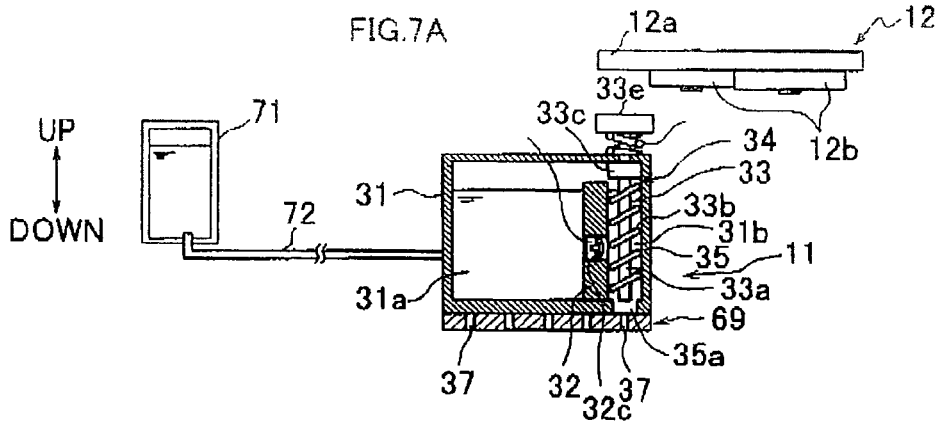
FIGS. 7A, 7B, 7C and 7D are diagrams showing operation of a continuous pressurizing process.

FIGS. 7A to 7D are diagrams showing operation of the screw driving portion 12 in the case of generating a continuous pressurized stream. Firstly as shown in FIG. 7A, the carriage 4 is moved so that the sub-tank 31 in which generation of a continuous pressurized stream is desired, that is, the sub-tank 31 corresponding to the recording head 69 (nozzles 37) on which recovery operation is to be performed, is positioned directly below the screw driving portion 12.

Figure 7B:
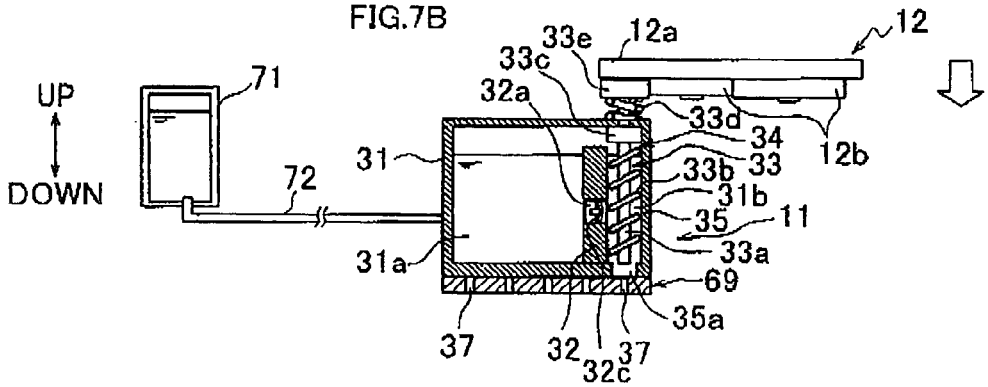
Figure 7C:
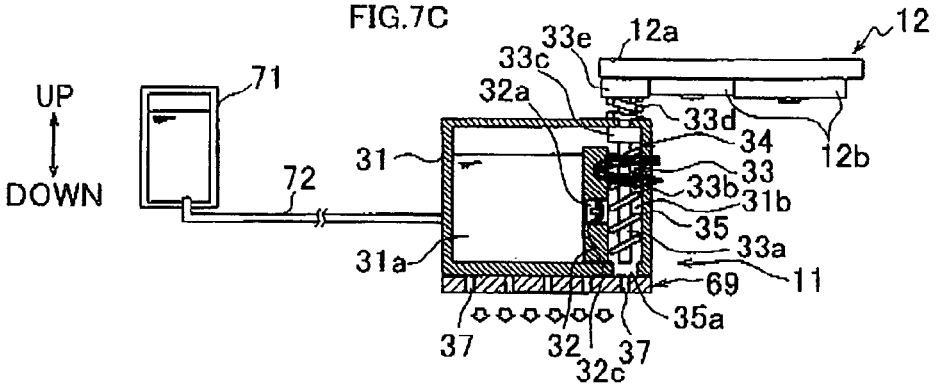

Next, as shown in FIG. 7B, the screw driving portion 12 is descended so that the gear 33*e* and the connecting gear 12*b* are engaged. Then, as shown in FIG. 7C, the connecting gear 12*b* is rotated so as to rotate the screw 33. Thereby, the ink inside the housing 35 (storage space 31) is continuously pressurized to the discharge opening 35*a* side. In conjunction therewith, the ink continuously flows from the cartridge 71 to the sub-tank 31. In this manner, a continuous pressurized stream is generated and the ink is discharged from the recording head 69 (nozzles 37).

Figure 7D:
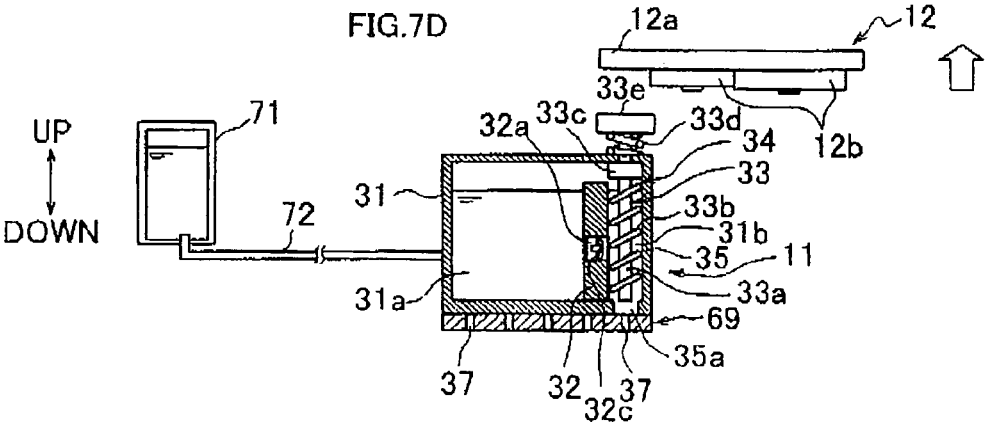

When terminating the recovery operation, the screw driving portion 12 is ascended until the gear 33*d* is no longer in contact with the connecting gear 12*b*, as shown in FIG. 7D.

The continuous pressurized stream is generated by rotating the screw 33 while the instantaneous pressurized stream is generated by moving the screw 33 in parallel to an axial direction. It is preferable that the moving (descending) speed of the screw driving portion 12 when connecting the screw driving portion 12 to the screw 33 in the case of generating the continuous pressurized stream is smaller than the moving speed in the case of generating the instantaneous pressurized stream.

This is because, in the case of the instantaneous pressurized stream, it is necessary to instantaneously move the screw 33 in parallel to an axial direction, while the continuous pressurized stream has nothing to do with the moving speed of the screw driving portion 12. Rather, in the case of continuous pressurized stream, if the moving speed is extremely large, there is a fear that the gear 33*e* and the connection gear 12*b* may not be engaged at the time of connection.

4.2. Control of Recovery Operation (Pressurized Stream)

FIGS. 8 to 15 are flowcharts showing control of the recovery operation. Hereinafter, the control of the recovery operation will be explained by way of the flowcharts.

4.2.1. Automatic Recovery Control (Automatic Purge Process)

Figure 8:
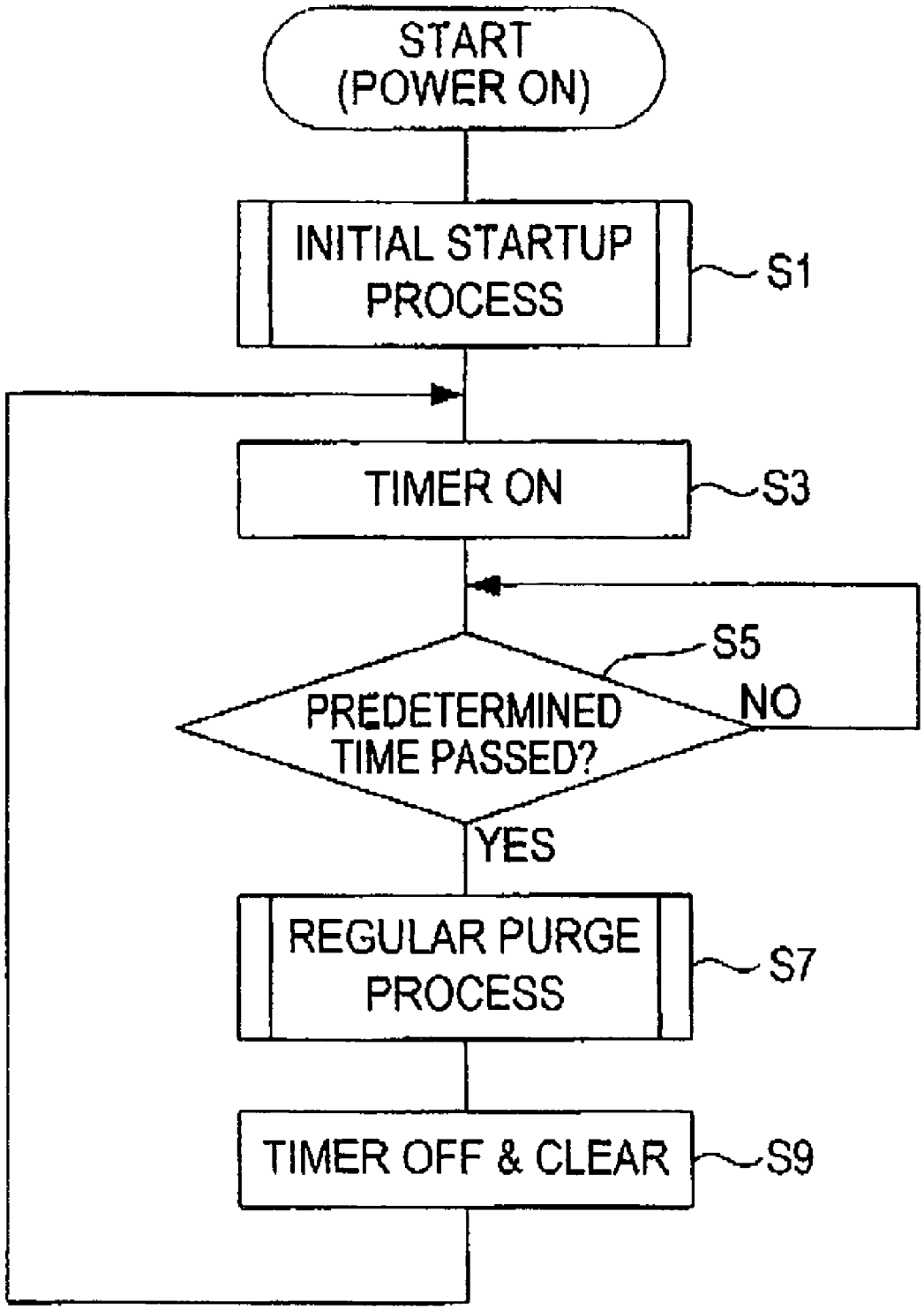
FIG. 8 is a flowchart illustrating main control.

FIGS. 8 to 13 are flowcharts showing automatic recovery control. FIG. 8 shows a main control flow of the automatic recovery control.

The main control flow shown in FIG. 8 is started once a power switch of the multi function apparatus 1 is turned on. Firstly, an initial startup process is performed (S1). Detail of the initial startup process will be explained later.

When the initial startup process (S1) is completed, a timer is started (S3). It is then determined whether a predetermined time (192 hours in the present embodiment) has passed since the timer is started (S5). If the predetermined time has passed (S5: YES), a regular purge process is performed (S7). Detail of the regular purge process (S7) will be explained later.

When the regular purge process is completed, the timer is stopped and initialized (S9). Again, the timer is started (S3). S3 to SO are repeated until the multi function apparatus 1 is powered off.

4.2.2. Initial Startup Process

Figure 9:
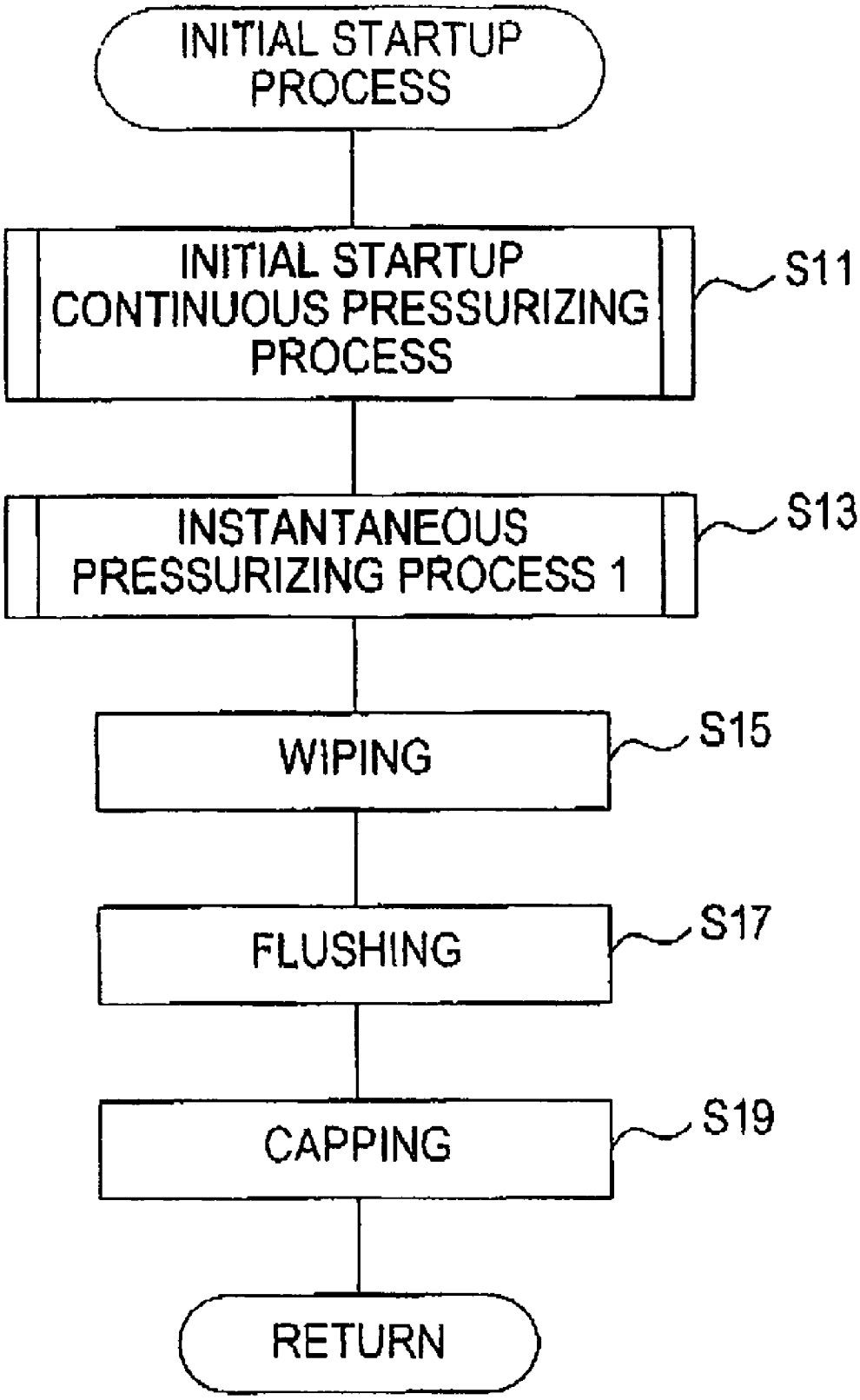
FIG. 9 is a flowchart illustrating an initial startup process.

FIG. 9 is a flowchart showing a control flow of the initial startup process. Firstly, a startup continuous pressurizing process is performed (S11). The startup continuous pressurizing process is a process of generating a continuous pressurized stream. Detail of the startup continuous pressurizing process will be explained later.

Figure 10:
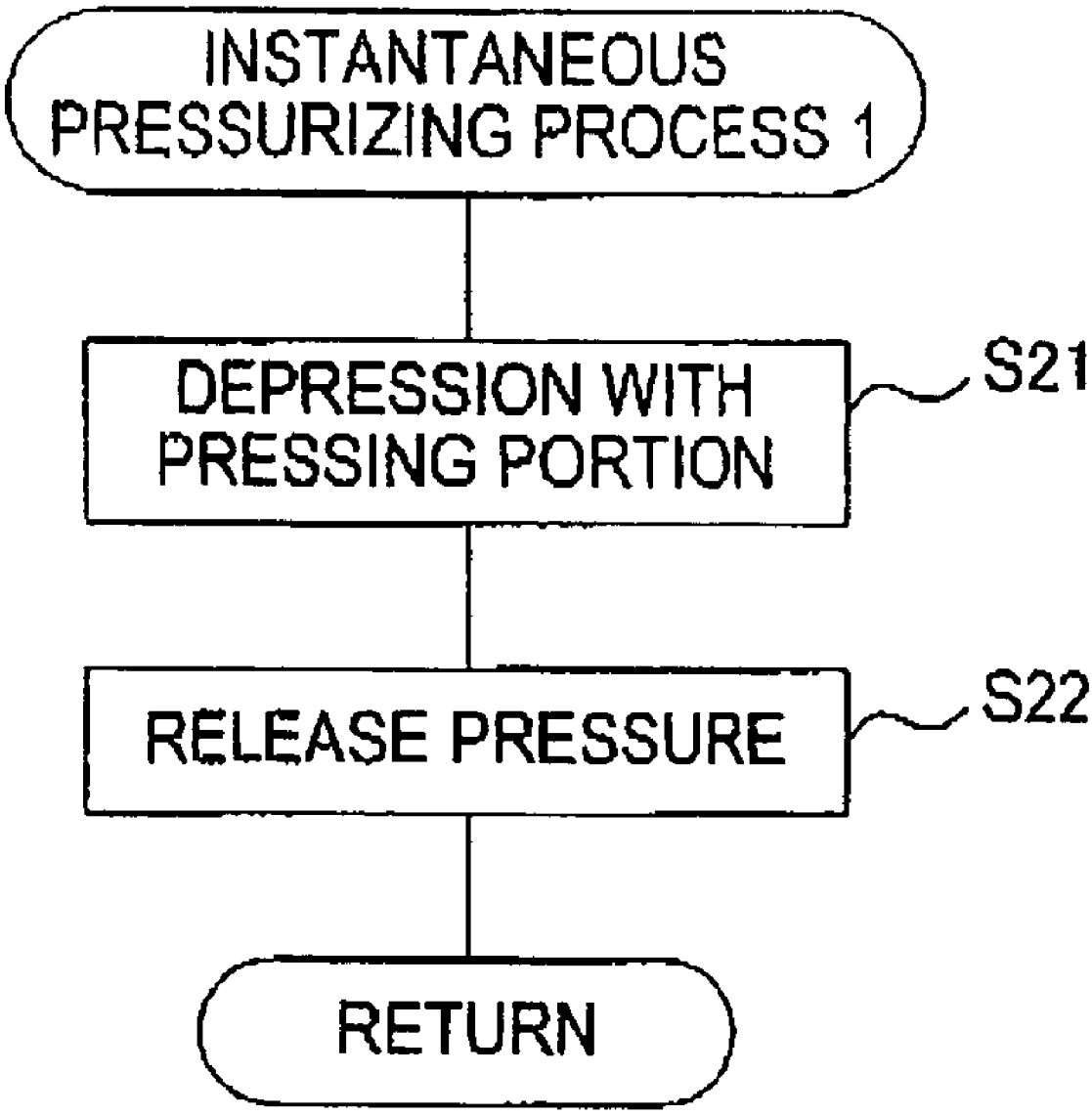
FIG. 10 is a flowchart illustrating an instantaneous pressurizing process 1.

When the startup continuous pressurizing process is completed, an instantaneous pressurizing process 1 is performed which generates an instantaneous pressurized stream (S13). The instantaneous pressurizing process 1 is a process, as shown in FIG. 10, of depressing the upper end side of the screw 33 by means of the slide pressing portion 12*a* to generate an instantaneous pressurized stream (S21) and then raising the slide pressing portion 12*a* to release pressure on the ink (S22).

When the instantaneous pressurized process 1 is completed, wiping is performed in which the opening plane of the nozzles 37 is wiped by the wiper blade 18 (S15) as shown in FIG. 9. Then, a piezoelectric device is driven and the ink is ejected from the recording head 69 in the same manner as in the case of actual recording onto the recording sheet 20 to perform flushing (S17).

When flushing is ended, the nozzles 37 are covered with the cap 21 (S19) to end the initial startup process. Here, covering the nozzles 37 with the cap 21 is called capping.

The reason why flushing is performed after wiping is because wiping causes mixing of a plurality of colors of ink on the opening plane of the nozzles 37. If left alone, the mixed ink may enter the nozzles 37 from the openings and change the color of ink inside the nozzles 37.

Therefore, after wiping, the carriage 4 is once returned to the position facing the waste ink tray 16 so that flushing is performed, thus preventing a change in color of ink inside the nozzles 37 due to possible entering of ink from the openings to the inside of the nozzles 37.

4.2.3. Startup Continuous Pressurizing Process

Figure 11:
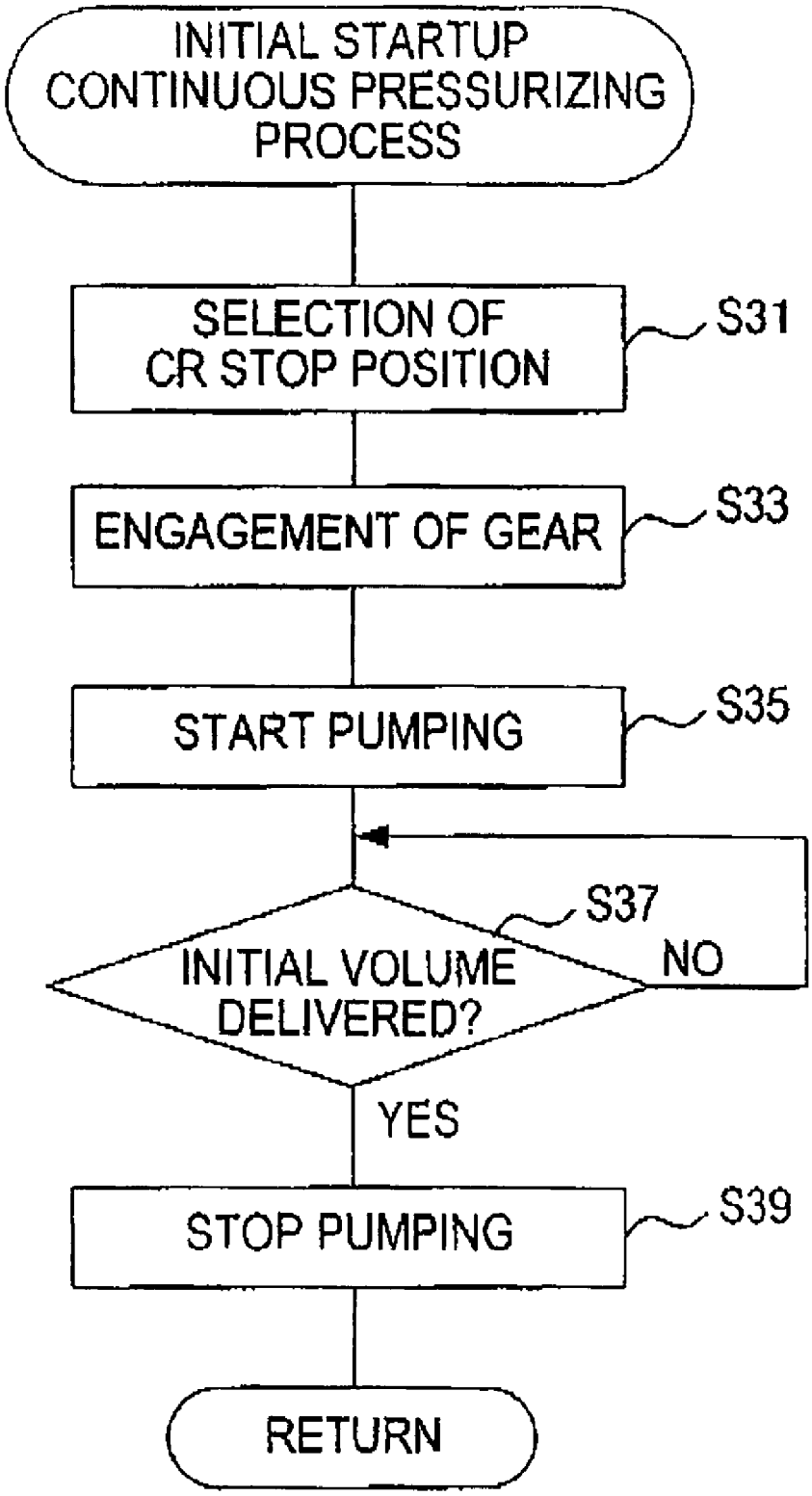
FIG. 11 is a flowchart illustrating the continuous pressurizing process for initial startup.

FIG. 11 is a flowchart showing the startup continuous pressurizing process. Firstly, the carriage 4 is moved so that the sub-tank 31 in which a continuous pressurizing stream is generated is positioned directly below the screw driving portion 12 (S31). Then, the screw driving portion 12 is descended so that the gear 33*e* is engaged with the connecting gear 12*b* (S33).

When the screw 33 starts to rotate (S35), it is determined whether an initial volume of ink has been delivered (S37). Here, the "initial volume of ink" corresponds to a volume of the ink supply passage from the cartridge 71 to the sub-tank portion 31*a*. In the present embodiment, whether or not the initial volume of ink has been delivered is determined by confirming whether a first predetermined time has passed since the screw 33 starts to rotate or whether the total revolution of the screw 33 has exceeded a first predetermined revolution.

When it is determined that the initial volume of ink has been delivered (S37: YES), the rotation of the screw 33, that is, drive of the screw pump 34 is stopped (S39) to end the startup continuous pressurizing process.

4.2.4. Regular Purge Process

Figure 12:
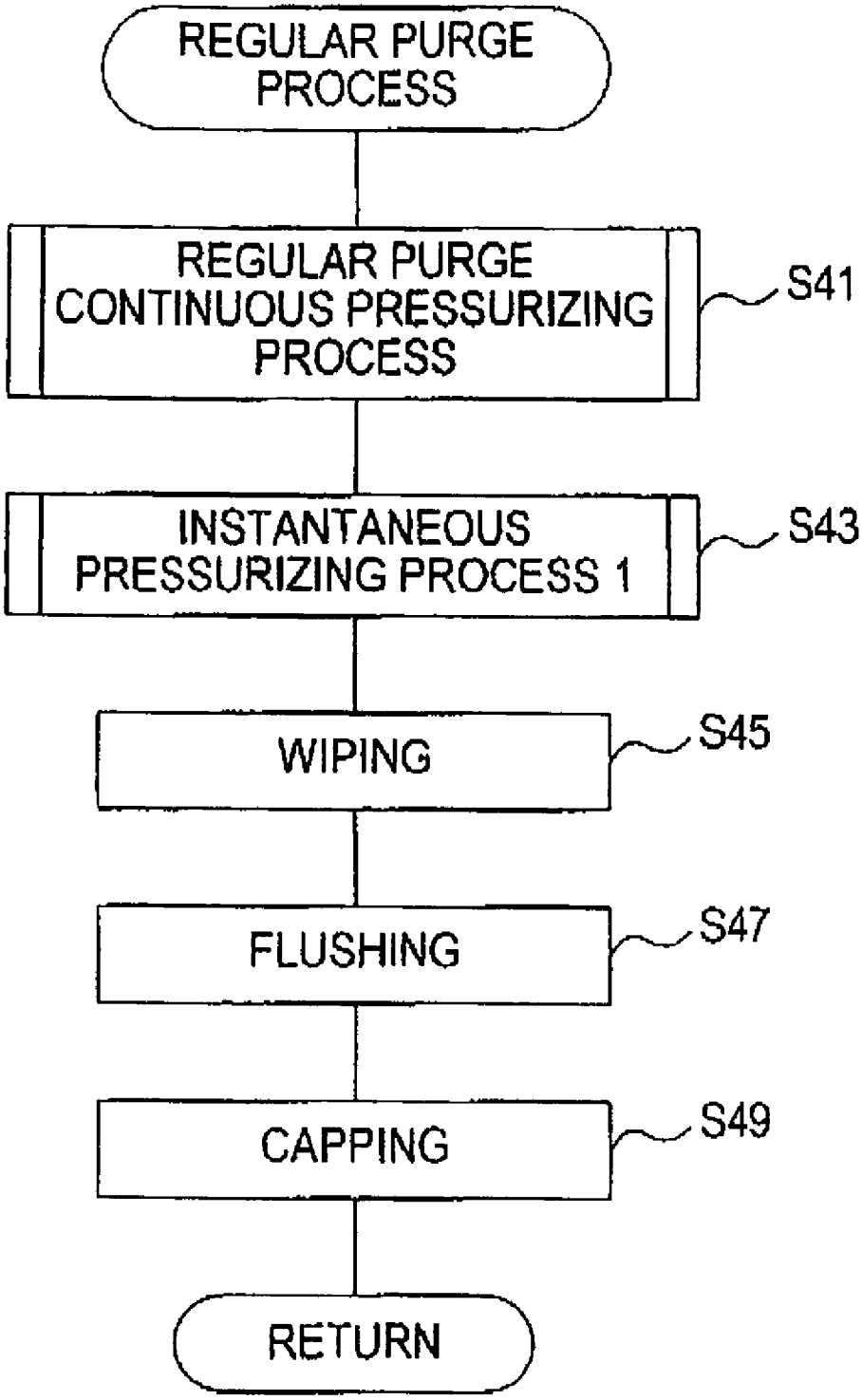
FIG. 12 is a flowchart illustrating a regular purge process.

FIG. 12 is a flowchart showing the regular purge process. Firstly, a regular purge continuous pressurizing process is performed (S41) and then the instantaneous pressurizing process 1 (See FIG. 10) is performed (843).

When the instantaneous pressurizing process 1 is completed (S43), wiping is performed (S45). Thereafter, flushing is performed (S47) and capping is performed (S49).

Figure 13:
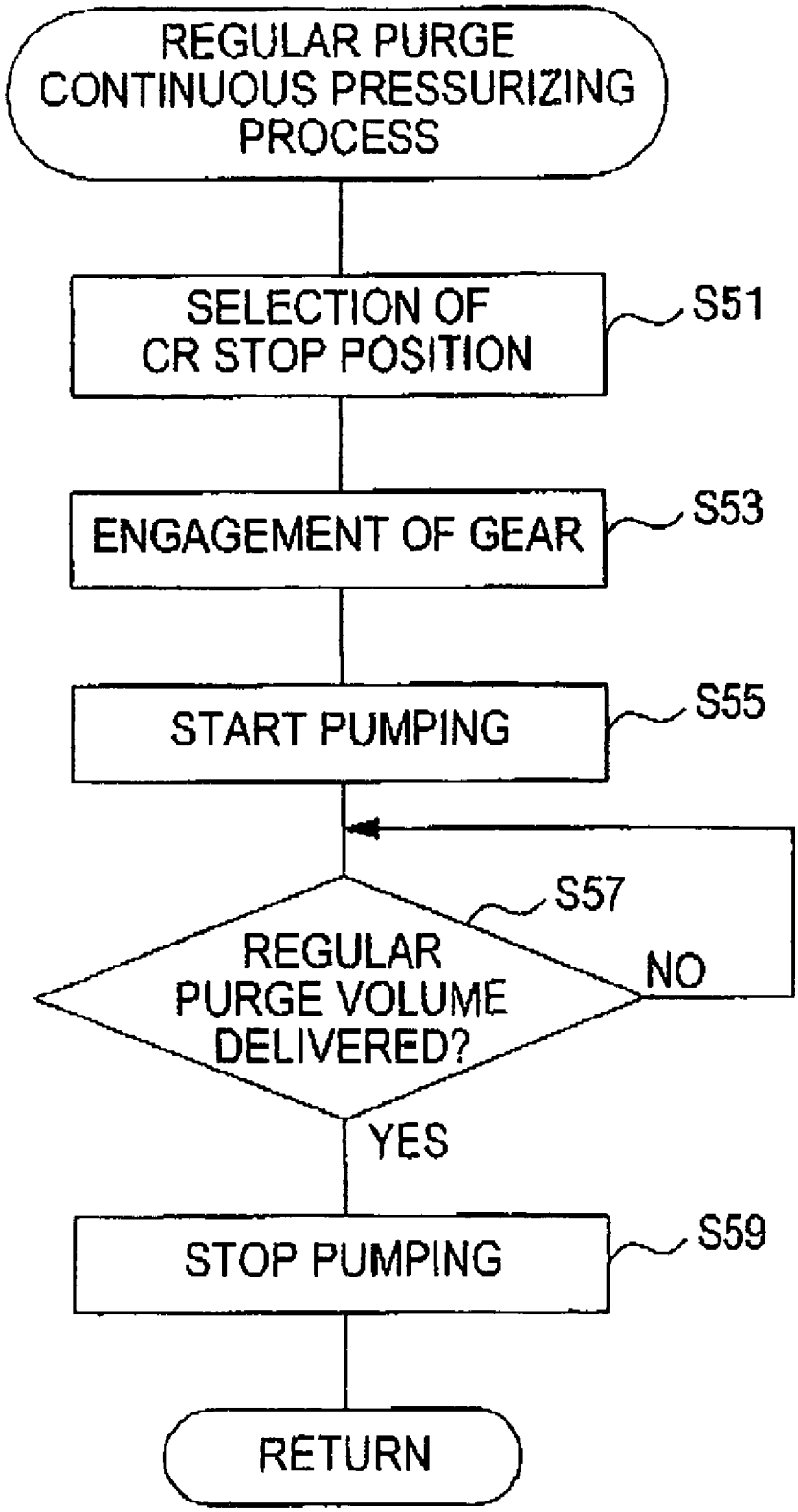
FIG. 13 is a flowchart illustrating the continuous pressurizing process for regular purge.

FIG. 13 is a flowchart showing the regular purge continuous pressurizing process. The regular purge continuous pressurizing process (FIG. 13) is different from the startup continuous pressurizing process (FIG. 11) only in the determination step of stopping the rotation of the screw 33. The other steps are identical.

That is, firstly, the carriage 4 is moved so that the sub-tank 31 in which a continuous pressurizing stream is generated is positioned directly below the screw driving portion 12 (S51). Then, the screw driving portion 12 is descended so that the gear 33*e* and the connecting gear 12*b* are engaged (S53).

When the screw 33 starts to rotate (S55), it is determined whether a regular purge volume of ink has been delivered (S57). Here, the "regular purge volume of ink" corresponds to a less volume of ink than a volume of the ink supply passage from the cartridge 71 to the sub-tank portion 31*a*. In the present embodiment, whether or not the regular purge volume of ink has been delivered is determined by confirming whether a second predetermined time which is shorter than the first predetermined time has passed since the screw 33 starts to rotate or whether the total revolution of the screw 33 has exceeded a second predetermined revolution which is smaller than the first predetermined revolution.

When it is determined that the regular purge volume of ink has been delivered (S57: YES), the rotation of the screw 33, that is, drive of the screw pump 34 is stopped (S59) to end the regular purge continuous pressurizing process.

4.3. Manual Recovery Control (Manual Purge Process)

The automatic purge process (FIG. 8) is a process which automatically performs the continuous pressurizing process and the instantaneous pressurizing process once the power switch is powered on. A manual purge process is a process started when a purge switch (cleaning switch) for the recovery operation is manually operated.

Figure 14:
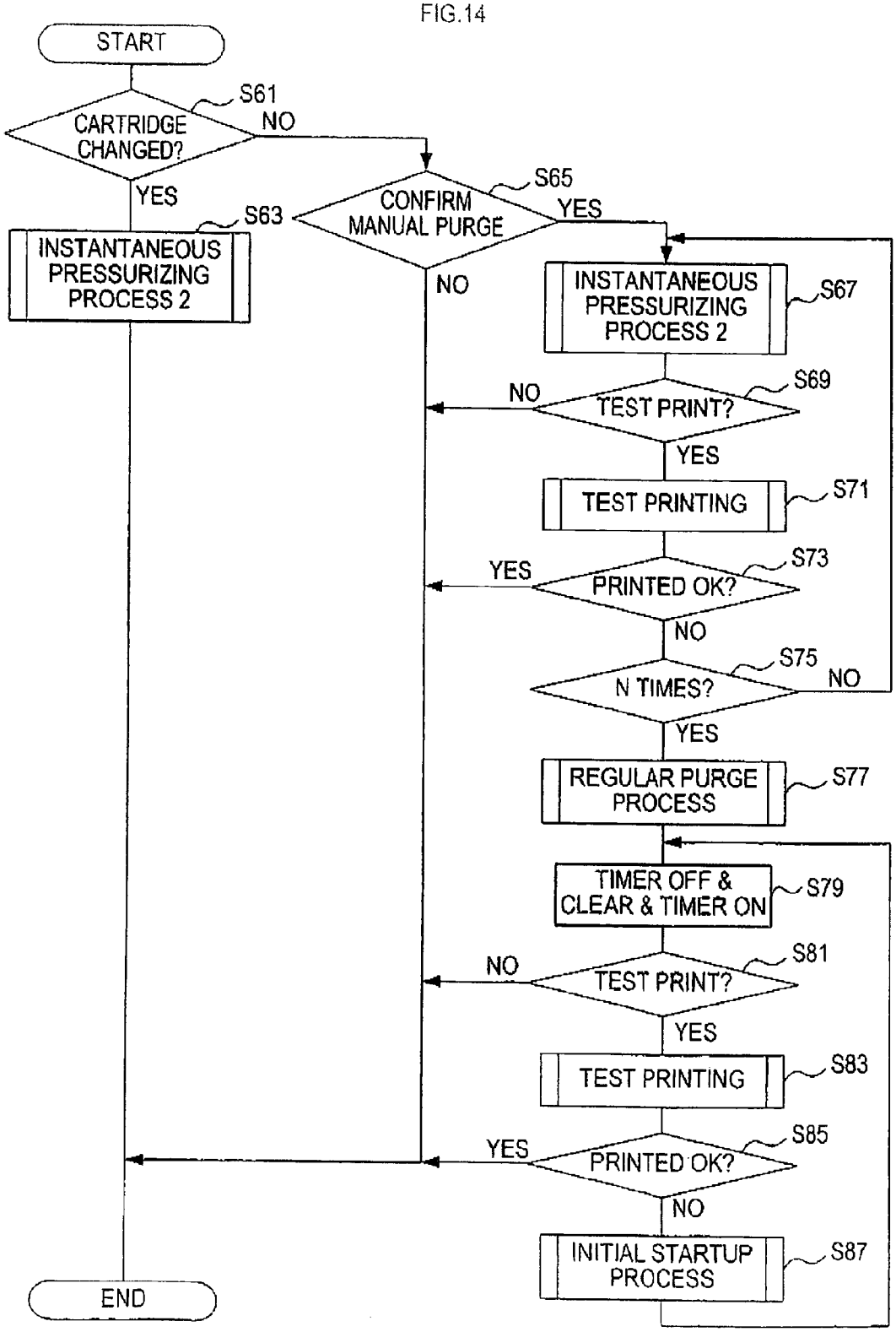
FIG. 14 is a flowchart illustrating a manual purge process.
Figure 15:
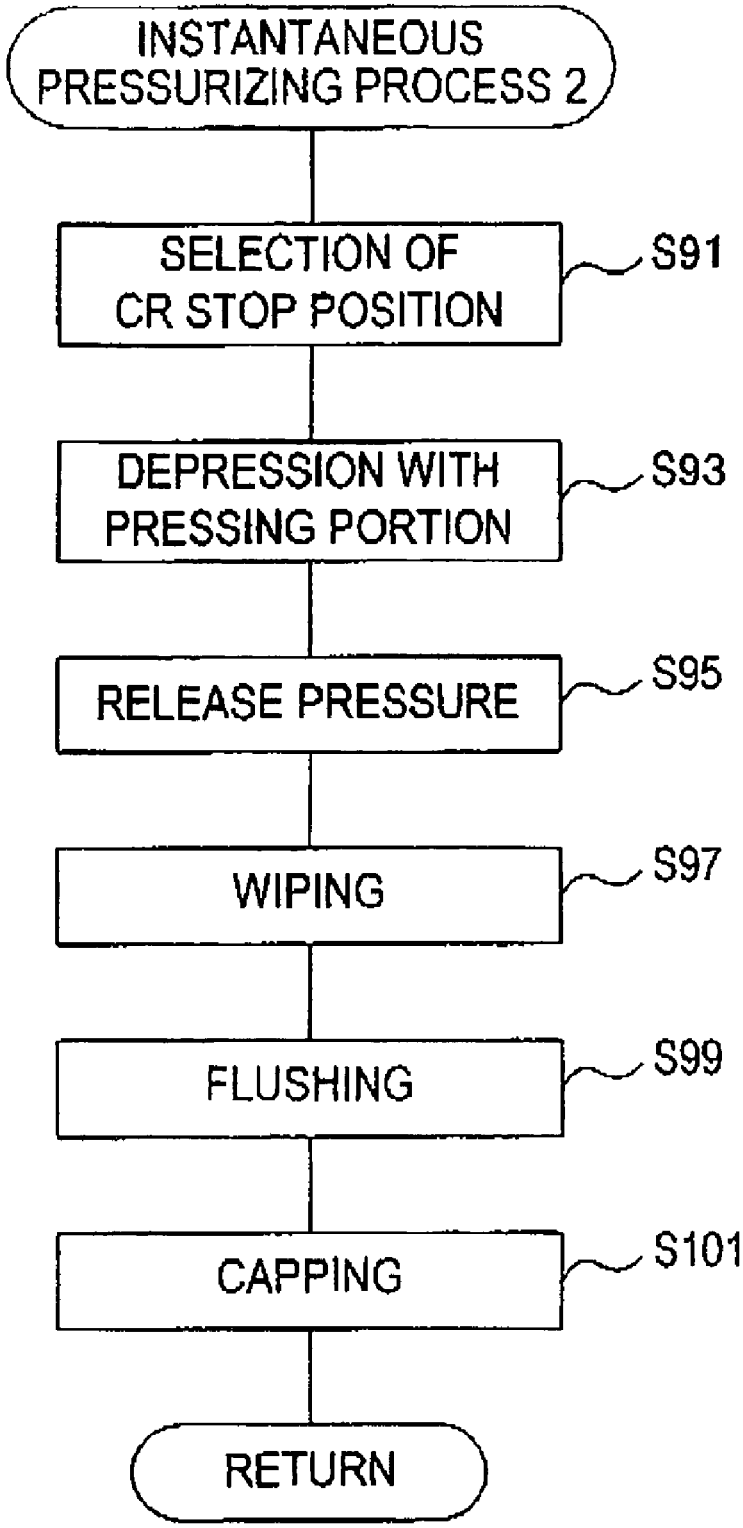
FIG. 15 is a flowchart illustrating an instantaneous pressurizing process 2.

FIG. 14 is a flowchart showing the manual purge process. When a user switches on the purge switch (cleaning switch), the manual purge process is started and whether the cartridge 71 has been exchanged is determined (S61).

In the present embodiment, it is determined that the cartridge 71 has been exchanged when the cartridge 71 in a state that the ink therein is less than a predetermined amount is removed and again installed.

When it is determined that the cartridge 71 has been exchanged (S61: YES), an instantaneous pressurizing process 2 is performed (S63). The instantaneous pressurizing process 2 is the process shown in FIG. 15, which outline is the same as the instantaneous pressurizing process 1.

That is, the carriage 4 is firstly moved so that the sub-tank 31 in which an instantaneous pressurizing stream is to be generated is positioned directly below the screw driving portion 12 (S91). Then, the screw driving portion 12 is descended so that the upper end side (gear 33*e*) of the screw 33 is depressed by the slide pressing portion 12*a* so that an instantaneous pressurized stream is generated (S93)

When the depression by the slide pressing portion 12*a* is ended, the slide pressing portion 12*a* (screw driving portion 12) is raised (S95) to perform wiping (S97). After wiping, flushing is performed (S99) and then capping is performed (S100), As noted above, when the instantaneous pressurizing process 2 is completed, the manual purge process-is ended as shown in FIG. 14.

When it is determined in S61 that the cartridge 71 has not been exchanged (S61: NO), it is confirmed whether the user has performed a confirming operation to continue the manual purge process, that is, whether the user has operated a manual purge process confirmation switch (not shown) (S65).

When it is confirmed that the user has performed a confirming operation to continue the manual purge process (S65: YES), the instantaneous pressurizing process 2 is performed (S67). Then, it is determined whether the user has instructed test printing (S69). When it is determined that the user has instructed test printing (S69: YES), test printing is performed and a counter value indicating the number of test printing is incremented (S71). On the other hand, when it is determined that the user has not instructed test printing (S69: NO), the manual purge process is ended.

Subsequently, it is determined that whether the result of the test printing is favorable, that is, whether the user has operated a button or a switch that indicates that the result of the test printing is favorable (S73).

When it is determined that the result of the test printing is favorable (S73: YES), the manual purge process is ended. When it is determined that the result of the test printing is not favorable (S73: NO), it is then determined whether the counter value is not less than a predetermined value N (N=2 in the present embodiment) (S75).

If the counter value is less than the predetermined value N (S75: NO), the process returns to S67 and again the instantaneous pressurizing process 2 is performed. On the other hand, if the counter value is not less than the predetermined value N (S75: YES), the regular purge process (see FIG. 12) is performed (S77). The timer started in the main control flow (see FIG. 8) is initialized (S79).

Subsequently, it is again determined whether the user has instructed test printing (S81). When it is determined that the user has instructed test printing (S81: YES), test printing is performed (S83). On the other hand, if it is determined that the user has not instructed test printing (S81: NO), the manual purge process is ended.

After the test printing, it is determined whether the result of the test printing is favorable (S85). When it is determined that the result of the test printing is favorable (S85: YES), the manual purge process is ended. When it is determined that the result of the test printing is not favorable (S85: NO), the initial startup process (see FIG. 9) is performed (S87). Then, the process returns to S79 to again initialize the timer (S79).

5. Feature of Ink-jet Recording Apparatus 7 of Present Embodiment

In the ink-jet recording apparatus 7 of the present embodiment, ink is not pressurized via the air present on the upper side of the sub-tank portion 31*a* (sub-tank 31). The ink in the sub-tank 31 is directly pressurized to perform the recovery operation. Thus, compared to the case of pressurizing the ink inside the sub-tank 31 via the air, a difference between the ink pressure inside the sub-tank 31 and the air pressure can be instantaneously increased to a required difference. Accordingly, wasteful consumption of ink at the operation of the recovery function can be avoided.

When removing bubbles and foreign bodies choked in the recording head 69, discharge (ejection) of ink present inside the recording head 69 is sufficient. Thus, it is only necessary to instantaneously (sporadically) pressurize the liquid inside the recording head 69.

On the other hand, the volume of ink present in the ink supply passage from the cartridge 71 to the sub-tank 31 (sub-tank portion 31*a*) is much larger than the volume of ink present in the recording head 69. Accordingly, in order to discharge (eject) bubbles and foreign bodies choked in the ink supply passage from the cartridge 71 to the sub-tank 31, it is necessary to continuously pressurize the ink so as to deliver a large volume of ink to the recording head 69 side.

In the present embodiment, generation of an instantaneous pressurized stream that instantaneously (sporadically) pressurizes the ink inside the recording head 69 and a continuous pressurized stream that continuously pressurizes the ink can be generated. Therefore, in either case of removing bubbles and foreign bodies choked in the recording head or in the ink supply passage from the cartridge 71 to the sub-tank 31, wasteful consumption of ink can be inhibited and further in the latter case, removal operation of bubbles and foreign bodies can be completed in a short time.

Accordingly, in the present embodiment, waste of ink can be prevented at the time of maintenance like recovery operation and initial startup. At the same time, maintenacibility can be improved.

The wing 33*b* of the screw 33 is spirally formed along the rotation shaft 33*a*. Therefore, a spiral space formed by the wing 33*b* is a space connecting one end through the other end in a longitudinal direction of the housing 35 (storage space 31*b*).

Accordingly, when the screw 33 is displaced to the discharge opening 35*a* side, pressure by an instantaneous pressurized stream may escape to the opposite side of the discharge opening 35*a*. There is a fear that a sufficient pressure difference may not be achieved.

In the present embodiment, there is provided the lid member 33*c* that closes the upper end part in a longitudinal direction of the housing 35 (storage space 31*b*) when the screw 33 is axially displaced. Thus, escape to the opposite side of the discharge opening 35*a* of pressure by the instantaneous pressurized stream which occurs when the screw 33 is displaced to the discharge opening 35*a* side can be reliably avoided. Accordingly, the pressure by the instantaneous pressurized stream can be certainly applied to the recording head 69 side.

Also in the present embodiment, the lid member 33*c* is integrally formed with the rotation shaft 33*a*. Thus, as soon as the screw 33 is axially displaced, the upper end side in a longitudinal direction of the housing 35 (storage 31*b*) is closed. Accordingly, the pressure by the instantaneous pressurized stream can be certainly applied to the recording head 69 side.

Furthermore, the communication path 32*a* is provided with the check valve 32*c*. Thus, at the time of generating an instantaneous or continuous pressurized stream, flow of the pressurized stream toward the sub-tank portion 31*a* side can be prevented. Accordingly, the pressure by the instantaneous pressurized stream can be certainly applied to the recording head 69 side.

As seen from the drawings, in the present embodiment, the communication path 32*a* is provided roughly at the mid-height part of the partition wall 32. The reason for this is explained hereinafter.

That is, the screw pump 34 pressure-feeds to the recording head 69 side the ink supplied through the communication path 32*a* into the housing 35 (storage space 31*b*). Here, the pumping action by the screw pump 34 operates only within the space from the communication path 32*a* to the discharge opening 35*a*.

Accordingly, in order for the screw pump 34 to effectively operate, it is preferable that the communication path 32*a* is provided on the upper end side of the partition wall 32 so as to increase a distance between the communication path 32*a* and the discharge opening 35*a*.

However, if the communication path 32*a* is provided on the upper end side of the partition wall 32, there is a fear that the ink may not be supplied from the sub-tank portion 31*a* to the housing 35 (storage space 31*b*) when the ink inside the sub-tank 31 (sub-tank portion 31*a*) is consumed to lower the liquid surface.

Therefore, in the present embodiment, the communication path 32*a* is provided at the mid-height part of the partition wall 32, so as to prevent the ink from not being supplied from the sub-tank 31*a* to the housing 35 (storage space 31*b*) while effectively operating the screw pump 34.

Also, in the present embodiment, when displacing the screw 33 in a rotation or axial direction, the carriage 4 is moved to relocate the head unit 11 at a position where the screw driving portion 12 is installed. Thus, without providing as many of the screw driving portion 12 as the number of the sub-tanks 31, an instantaneous or continuous pressurized stream can be generated.

Accordingly, maintenancibility can be improved while preventing an increase in manufacturing cost and size of the ink-jet recording apparatus 7 and while preventing wasteful consumption of the liquid at the time of maintenance like recovery operation and initial startup.

Furthermore, in the present embodiment, a recovery operation (purge process) is automatically performed per predetermined time. Thus, failure can be avoided due to attachment of the ingredients of ink in the form of a solid body or a slurry inside the recording head 69 (nozzles 37) before happens.

Additionally, in the recovery operation (purge process) automatically performed, the instantaneous pressurizing process is performed after the completion of the continuous pressurizing process. Therefore, after the removal of foreign bodies and the slurry ingredient with increased viscosity which are choked in the ink supply passage from the cartridge 71 to the sub-tank 31, the foreign bodies and the like attached inside the recording head 69 (nozzles 37) are removed. Thus, reliability of the recovery process is ensured.

Also in the manual purge process, the instantaneous pressurized process precedes the continuous pressurized process. Therefore, removal of the foreign bodies and the like attached inside the recording head 69 (nozzles 37) is given priority. Accordingly, the removal can be completed in short time.

Other Embodiments

The screw driving portion 12 may be separated into two. A screw rotation portion and a screw displacement portion may be independently provided instead of the integrated screw driving portion 12.

In the above embodiment, the carriage 4 is moved so as to select the sub-tank 31 to which the recovery process is performed. However, the same number of screw driving portion 12 may be provided as the number of the sub-tanks 31, so that the recovery process may be performed without moving the carriage 4.

In the above embodiment, the housing 35 and the sub-tank 31 integrally constitute the sub-tank 31. However, the housing 35 and the sub-tank 31*a* may be formed separately.

In the above embodiment, the lid member 33*c* and the screw 33 are integrated. However, the lid member 33*c* may be separately formed so as to close the upper end side in a longitudinal direction of the housing 35 (storage 31*b*) in conjunction with the displacement of the screw 33.

Additionally, the position of the communication path 32*a* should not be limited to the substantially middle part in a vertical direction as shown in FIG. 4.

In the above embodiment, an instantaneous pressurized stream is generated once when the screw 33 is pressed once in the instantaneous pressurizing process. However, the instantaneous pressurized stream may be generated a plural number of times during one cycle of the process.

The present invention may be applied to a soldering machine which ejects melted solder from nozzles onto various printed circuit boards for automatic soldering, an apparatus that ejects high molecule organic material (luminous body) in an ink-jet manner to form organic coating upon manufacturing an organic EL display, or an apparatus that ejects resin in a slurry form from nozzles. The present invention may be applied to various droplet ejection apparatus which are designed to eject liquid stored in a sub-tank as droplets from nozzles.

The present invention should not be limited to the above embodiment and can be practiced in various manners without departing from the technical scope of the invention.

What is claimed is:

1. A droplet ejection apparatus comprising:

a main tank that stores liquid;

a head unit that includes a sub-tank that temporarily stores the liquid fed from the main tank and an ejection head that ejects the liquid fed from the sub-tank as droplets;

a head unit transfer device that transfers the head unit to a predetermined position;

a displacement member that is disposed to freely move in the liquid in a liquid supply passage from the sub-tank to the ejection head;

a continuous pressurizing unit that continuously moves the displacement member, so that the displacement member directly applies continuous positive pressure to the liquid; and an instantaneous pressurizing unit that instantaneously moves the displacement member, so that the displacement member directly applies instantaneous positive pressure to the liquid.

2. The droplet ejection apparatus according to claim 1, further comprising:

a housing that accommodates the displacement member and has a discharge opening;

wherein the liquid is delivered toward the ejection head side via the discharge opening.

3. The droplet ejection apparatus according to claim 2;

wherein the housing and the sub-tank are integrally formed; and wherein a control device is provided which switchably operates the continuous pressurizing unit and the instantaneous pressurizing unit.

4. The droplet ejection apparatus according to claim 2;

wherein a control device is provided which switchably operates the continuous pressurizing unit and the instantaneous pressurizing unit.

5. A droplet ejection apparatus comprising:

a main tank that stores liquid;

a head unit that includes a sub-tank that temporarily stores the liquid fed from the main tank and an ejection head that ejects the liquid fed from the sub-tank as droplets;

a head unit transfer device that transfers the head unit to a predetermined position;

a screw pump device that includes a screw having a rotation shaft displaceably supported in an axial direction and a spiral wing formed on the rotation shaft, and a housing forming a cylindrical storage space for accommodation of the screw and having a discharge opening, the screw pump device delivering the liquid toward the ejection head side;

a screw rotation device that rotates the screw; and a screw displacement device that axially displaces the screw to the discharge opening side.

6. The droplet ejection apparatus according to claim 5, further comprising:

a lid member that closes an end opposite to the discharge opening of the storage space when the screw is axially displaced.

7. The droplet ejection apparatus according to claim 6;

wherein the lid member is integrally formed with the rotation shaft.

8. The droplet ejection apparatus according to claim 5;

wherein a check valve that prevents adverse current of ink from the storage space to the sub-tank is provided in a communication path that communicates the storage space and the sub-tank.

9. The droplet ejection apparatus according to claim 5;

wherein the housing and the sub-tank are integrally formed; and wherein a transfer control device is provided which operates the head unit transfer device to transfer the head unit to a position where the screw rotation device or the screw displacement device is installed when displacing the screw in a rotational or axial direction.

10. An ink-jet recording apparatus comprising the droplet ejection apparatus according to claim 5;

wherein the ink-jet recording apparatus ejects ink onto a recording medium by the droplet ejection apparatus.

11. The ink-jet recording apparatus according to claim 10, further comprising:

a regular auto operation device that operates the screw rotation device and the screw displacement device per predetermined time.

12. The ink-jet recording apparatus according to claim 11;

wherein the regular auto operation device operates the screw rotation device prior to operation of the screw displacement device.

13. The ink-jet recording apparatus according to claim 10, further comprising:

a manual operation device that operates the screw rotation device or the screw displacement device according to user's instructions;

wherein the manual operation device operates the screw displacement device in preference to the screw rotation device.

* * * * *